US006070941A

United States Patent [19]

Chung

[11] Patent Number: 6,070,941

[45] Date of Patent: Jun. 6, 2000

[54] KNOCK DOWN WINDSOR CHAIR

[75] Inventor: Donna Chung, Petaling Jaya, Malaysia

[73] Assignee: Collins International Co., Ltd, Fair Lawn, N.J.

[21] Appl. No.: 09/361,833

[22] Filed: Jul. 27, 1999

[51] Int. Cl.[7] ..... A47C 7/00

[52] U.S. Cl. ..... 297/440.16; 297/440.22; 297/440.1

[58] Field of Search ..... 297/440.1, 440.15, 297/440.16, 440.21, 452.18, 445.1, 449.1

[56] References Cited

U.S. PATENT DOCUMENTS

| | | |
|---|---|---|
| 22,297 | 12/1858 | Lytle et al. . |
| 1,392,242 | 9/1921 | Albergoli . |
| 1,650,697 | 11/1927 | De Frehn . |
| 2,703,136 | 3/1955 | Masse . |
| 2,755,846 | 7/1956 | Shepherdson . |
| 3,115,367 | 12/1963 | Gariepy . |
| 3,146,029 | 8/1964 | Gariepy . |
| 3,704,912 | 12/1972 | Bezark . |
| 3,727,981 | 4/1973 | Ostroff et al. . |
| 5,026,121 | 6/1991 | Ratalahti . |
| 5,356,204 | 10/1994 | McDonough . |
| 5,678,892 | 10/1997 | Heitlinger . |
| 5,795,029 | 8/1998 | Ma . |

*Primary Examiner*—Milton Nelson, Jr.
*Attorney, Agent, or Firm*—C. G. Nessler

[57] ABSTRACT

A knock down chair is comprised of a seat, a back rest, and a leg assembly. The back rest has a hoop, the tapered ends of which are drawn by bolts into spaced apart holes running through the seat. The back rest has spindles or other members running downwardly to a base plate which is removably attached to the top surface of the seat. The base plate is offset toward the rear of the seat from the plane in which the hoop ends lie. The leg assembly is comprised of two opposing leg frames which are screwed to the bottom of the seat. Rungs of the leg frames are joined by a stretcher rail which is held in place by bolts acting similarly to the bolts of the hoop ends.

10 Claims, 4 Drawing Sheets

KNOCK DOWN WINDSOR CHAIR

TECHNICAL FIELD

The present invention relates to furniture, in particular to mass-production chairs designed to be shipped from a factory in disassembled (knocked-down) condition, so they can be assembled by a purchaser.

BACKGROUND

Many articles of furniture are costly to ship because they are by nature bulky and prone to damage during transport. Therefore, it has been common to make knock down type mass-market furniture. Knock down furniture is fabricated as components, or sub-assemblies, which can be compactly packaged and economically shipped. The furniture is subsequently assembled by a retailer or a consumer using simple tools, such as common wrenches, screwdrivers, hexagonal wrenches, and the like. Most often such furniture can be subsequently disassembled, if desired. However, the advantages of knock down design will not be realized if such a design compromises the article's appearance or function, or if the article is too hard to assemble.

What constitutes a compromise in appearance for a knock down article depends on an esthetic judgment, and that may vary with the individual. Nonetheless, there are some general principles which may be stated. For example, most people would conclude it is esthetically undesirable to have exposed industrial-type metal fasteners on a wooden chair. Similarly, if the knock down design involved significant changes in the proportions or shapes of the parts of a chair, compared to a traditional chair design which was obviously being emulated, then there would be a high risk that consumers would think the chair looked strange, and they would not purchase it.

A knock down design which compromises function becomes evident when the piece of furniture is put into use. A chair may be subjected to very high loads. For instance, the chair may set on an uneven surface, a user may tilt the chair backward on the rear legs, or the chair may fall over onto a hard floor. Consequently, a knock down chair must not only have strength and rigidity when first assembled, but it must maintain such during its lifetime.

In furniture which is factory-assembled, it is possible to use heavy machinery and special processes. It is possible to use tight fits, diverse fasteners, and special adhesives; all to obtain the strength and durability the product demands. In contrast, by the nature of knock down furniture, there will be joints which must be made by unskilled consumers using simple hand tools. Thus, in some poorly designed knock down furniture the joints will be weak and furniture will be flimsy when initially assembled. In other such furniture, joints will loosen with time or even fail during use. In still other furniture, the knock down design may provide good strength, but be too complex for unskilled consumers to assemble correctly. And of course, a piece of knock down furniture has to be economic to manufacture, otherwise the advantage produced by lower packaging and transport costs, compared to a one-piece factory assembled chair, will be offset.

So, it is not easy to make a piece of knock down furniture which satisfactorily meets all the requirements. Of course, there have been many successful designs of knock down furniture. Specialized fasteners have been developed. However, certain designs of furniture by their nature still present problems which are more difficult to overcome than others. For example, joints which are made at obvious locations can be subject to inherently high stresses, as is the case when a cantilevered back rest of a chair is joined to the chair seat. Therefore, there is a continuing search for new knock down concepts and joint designs.

SUMMARY OF THE INVENTION

An object of the invention is to provide an improved knock down chair construction, where the back rest, seat and leg base are easily assembled and economical to manufacture. A further object is to provide such a chair, particularly a Windsor style chair, which has a high strength and high rigidity back rest that is readily attachable to and detachable from the seat by an unskilled consumer.

In accord with the invention a knock down chair is comprised of three essential components: a seat, a leg assembly, and a back rest. The back rest is comprised of a hoop which has an upper portion and spaced apart lower ends which ran downwardly into spaced apart holes running top to bottom through the seat. One or more members, preferably a multiplicity of spindles, runs downwardly from the upper portion of the hoop to a base plate which is fastened to the top of the seat. The base plate is preferably offset toward the rear of the seat from the nearly-vertical plane of the lower ends of the hoop. Fasteners hold the lower ends of the hoop within the holes of the seat by pulling the ends lengthwise into the holes. Fasteners also pass run up from the bottom of the seat, to hold the base plate in position.

Preferably, when the back rest members comprise a multiplicity of spindles, they are permanently attached to both the base plate and the upper end of the hoop, as by gluing. Preferably, the lower ends of the back rest hoop have conical sections which engage the upper portions, or openings, of seat cylindrical holes, and the fasteners are bolts which engage barrel nuts that are set within the ends of the hoop.

Preferably, the chair also comprises a leg assembly made up of two spaced apart frames. Each frame is comprised of two angled legs running down to the floor from a top plate which is attached to the bottom side of the seat by fasteners. Each pair of downwardly angled legs are joined by a horizontal rung. The rungs of the opposing frames are connected by a stretcher rail. The stretcher rail is connected to each rung by means of a bolt and barrel nut, using a construction similar to that employed to attach the hoop ends to the seat.

The invention provides a chair which is feasibly and economically manufactured, which is easy to assemble, and which can be easily disassembled if desired. The chair is very strong and rigid. The foregoing and other objects, features and advantages of the invention will become more apparent from the following description of preferred embodiments and accompanying drawings.

DESCRIPTION

A Windsor chair is a type of chair in which the back rest is comprised of slender spindles running vertically upward from the seat. The preferred embodiment of the present invention which is described below is a plain Windsor type chair which has a hoop type back rest. It does not have arms. Of course, Windsor type chairs can have other shapes of back rests, and they often have arms. It will be understood that the invention will be useful in diverse other variations of Windsor type chair construction. It will also apply to other kinds of chairs which have back rests that present the same kind of structural and design challenges as does the Windsor type chair which is described herein.

Figure 1:
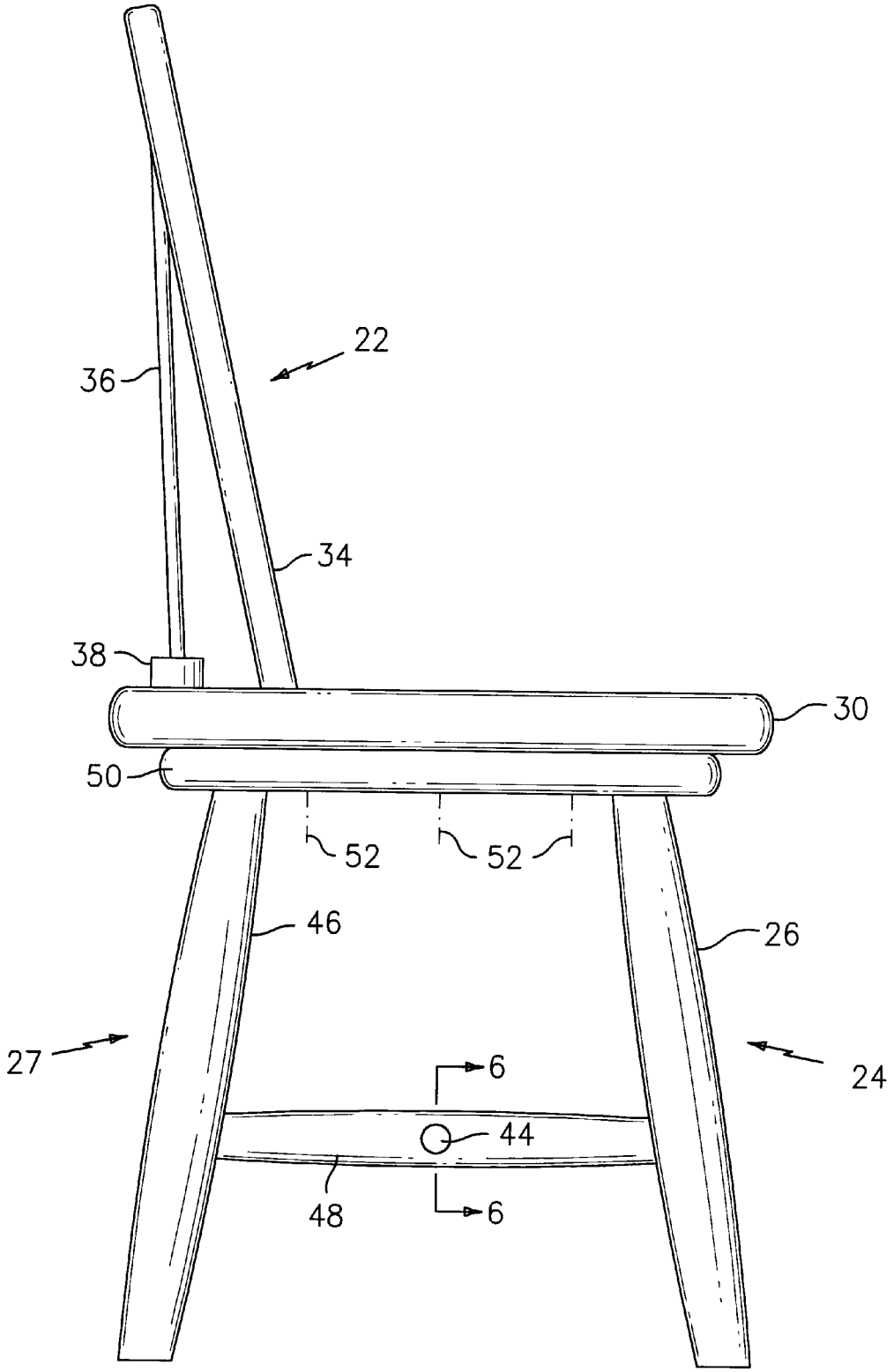
FIG. 1 is a side elevation view of a chair having features of the invention.
Figure 2:
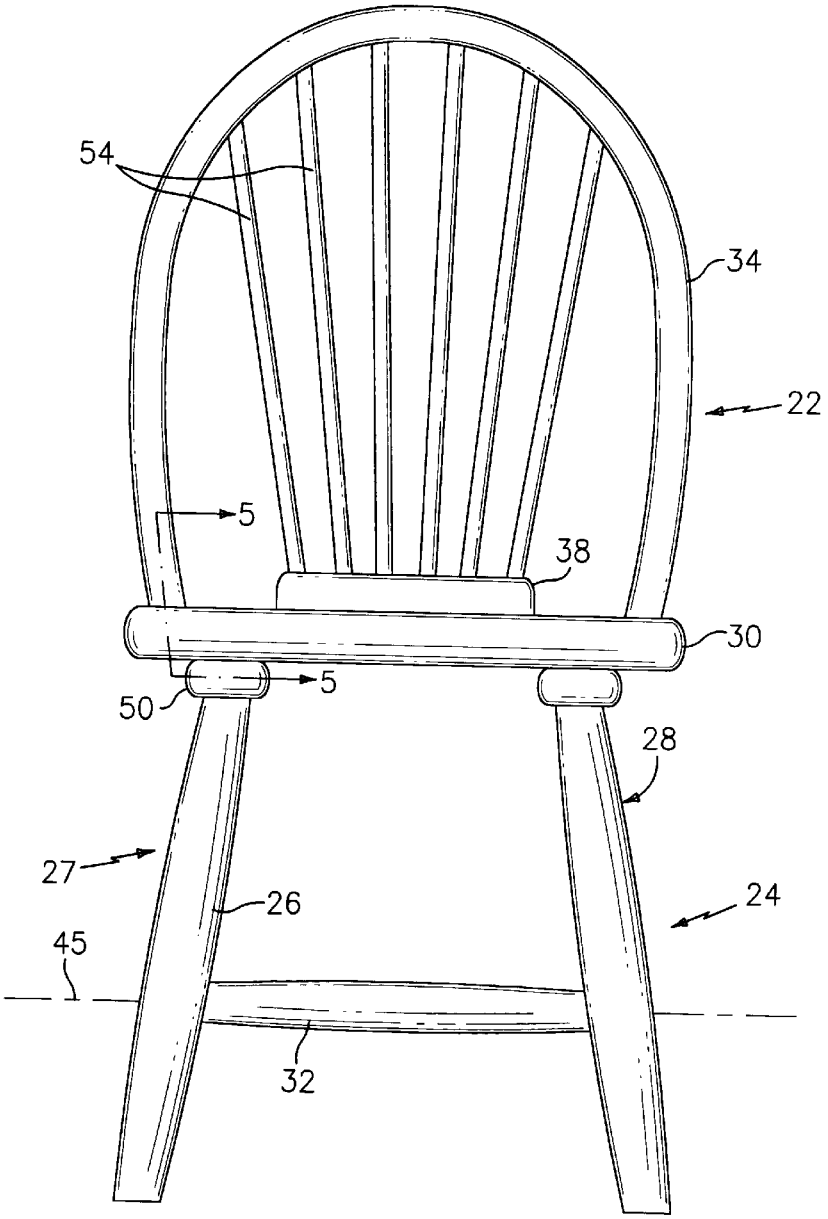
FIG. 2 is a front elevation view of the chair shown in FIG. 1.

FIGS. 1 and 2 show in side and front view, respectively, a wooden knock down Windsor chair which has a hoop back. The chair is referred to commercially as a Sunburst Windsor Chair. The trademark Sunburst arises from the imagination, in that the spindles of the back can be imagined as rays emanating upwardly from a setting or rising sun at the horizon. The chair is comprised of three essential components or subassemblies: the back rest 22, the seat 30, and the leg assembly, or base, 24.

In use, the back rest 22 must be firmly attached to the seat 30, especially for resisting a backward or forward bending force. Thus, it is designed and attached to the seat in a particular way. Referring to FIGS. 1–4, the back rest is comprised of a hoop 34 which has mostly a nominal square cross section. The lower end 37 of each side of the hoop is machined to provide a tapered or conical section 36 and a straight cylinder terminal section 31. See FIG. 4. Six back rest members, slender spindles 54, run vertically downward from the top portion of the hoop to the spindle base plate 38, at small and varied angles from the vertical. The spindle ends are glued into sockets at the top of the hoop and at the base plate. The base plate is offset, toward the rear of the chair, from the nearly vertical plane 35 in which the hoop ends lie. The lower ends of the conical sections 36 of the hoop ends 37 extend vertically downwardly to beneath the bottom plane 31 of the base plate, and of course, when assembled, to beneath the generally horizontal top surface of the seat. See FIG. 3.

Figure 3:
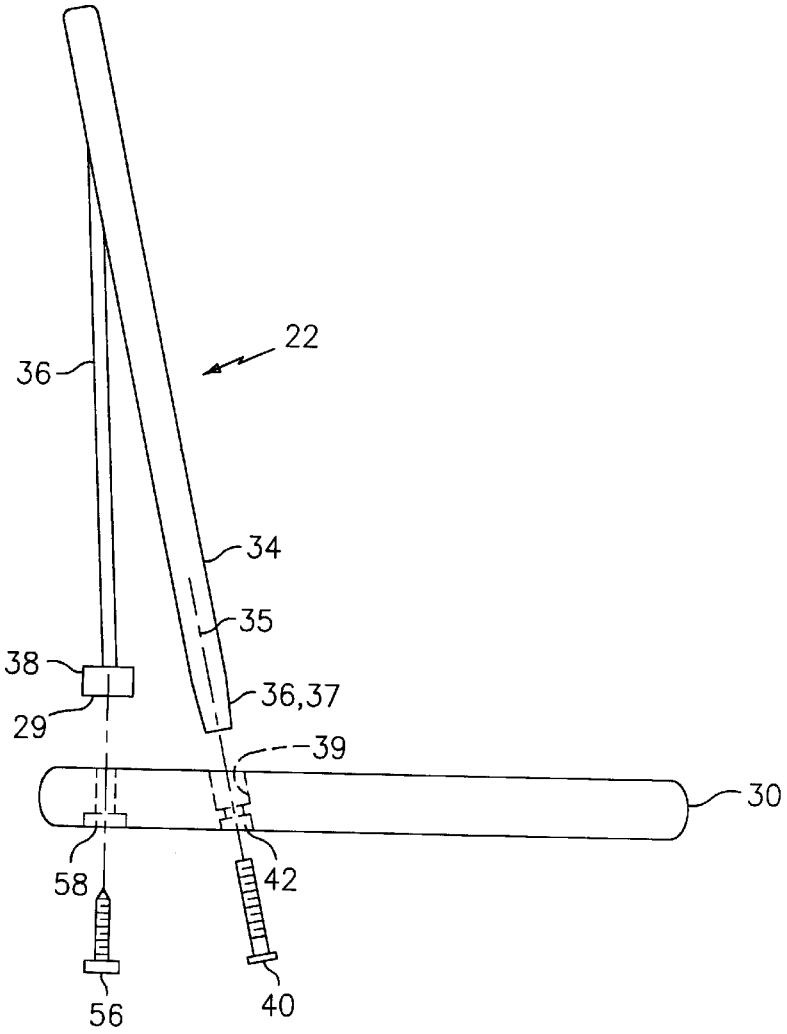
FIG. 3 is a side view of two of the main components of the FIG. 1 chair, illustrating how the back rest attaches to the seat.

FIG. 3 shows how the backrest 22 mates with the seat 30. The hoop ends 37 fit into angled cylindrical holes 39 in the seat, while the base plate 38 is fastened to the surface of the seat. Each hoop end is held in place by a long machine thread bolt 40. The base plate 38 is fastened to the seat by screws 56 which slip into shaped holes 58.

Figure 5:
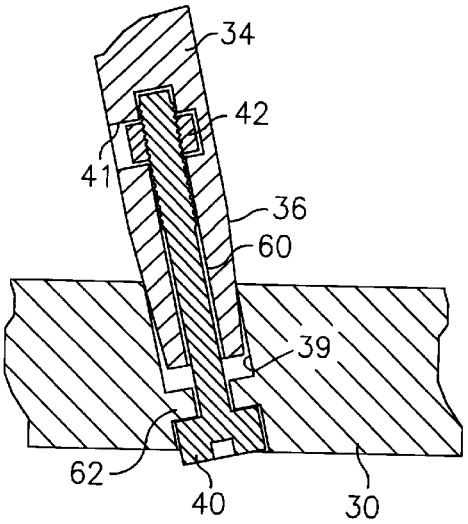
FIG. 5 is a fragmentary cross section through the joint formed between the end of a back rest hoop and the seat The view is rotated 90 degrees from the view of FIG. 4.
Figure 4:
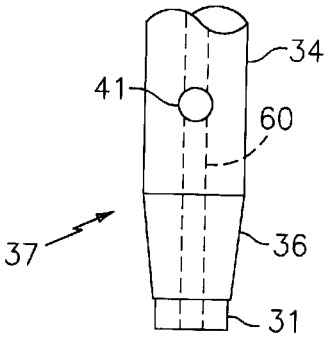
FIG. 4 is a detail rear elevation view of the end of the hoop of the chair back rest.

FIGS. 4 and 5 show in more detail how each hoop end 37 is engaged with the seat 30. The lower end 37 of each hoop has a lengthwise hole 60 and a transverse hole 41. See FIG. 4. The cylindrical hole 39 in the seat is stepped, to provide an internal shoulder 62 near its lower end which is adapted to engage the head of a bolt. (Alternatively, the hole configuration described in connection with FIG. 7 may be used.) A bolt 40 is placed into the hole 39 from the bottom of the seat, and runs upwardly, to and within the hole 60 of the hoop end, to engage barrel nut 42. The barrel nut is a cylinder, having a transverse threaded hole, which fits snugly in the transverse hole 41 of the hoop end. Tightening of the bolt thus creates force which causes the bolt to press upwardly on the bottom side of the seat and the hoop end to be drawn lengthwise downward, into the hole 39, so the conical section 36 wedges firmly within the upper part of the hole.

Hoop and seat joints which are so made provide good resistance to any bending force applied to the back rest. The hoop-to-seat joints combine with the base plate-to-seat joint, to impart high rigidity and strength to the back rest. This is especially so due to the fact that the base plate attachment location is offset rearwardly from the plane 35 of the hoop ends, so that in assembled side elevation view (FIG. 1) a rigid triangle shape structure is formed by the hoop, the spindles and the seat.

Figure 6:
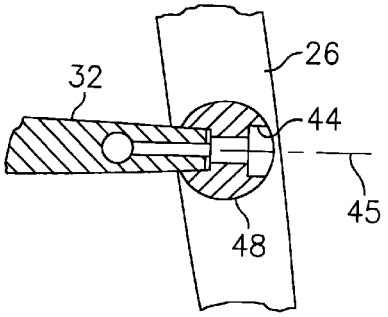
FIG. 6 is a vertical cross section of the joint formed between the stretcher and a rung of the chair base or leg assembly.

With reference to FIGS. 1 and 2, the chair has a base 24. It is comprised of two frames 27, 28 which are connected by a stretcher rail 32. Both frames are constructed and attached to the seat similarly. Typical frame 27 is comprised of two legs 26, 46. The legs are glued to, and run downwardly from top plate 50. The legs are connected by a glued rung 48. Top plate 50 of frame 27 is screwed to the bottom of seat 30 at three locations 52. See FIG. 1. As illustrated in FIG. 6, the end of the stretcher rail 32 has an interior shape like that of the hoop end, thus enabling a barrel nut and bolt to be used to hold it in place. The exterior of the stretcher rail has a gracefully tapered end. The end is thus wedged within the interior end of shaped cylindrical hole 44 when a bolt is inserted along axis 45, to engage a barrel nut inserted into the stretcher. The stretcher is thereby firmly held in place, in analogous fashion to the fastening of the hoop end. When assembled, the base of the chair thus has high strength and rigidity. If desired, it may be disassembled, provided the user has not optionally applied any glue to the mating component surfaces during assembly.

There is a degree of interdependency between the design of the leg base assembly and the design of the seat and back rest. The top plates of the leg frames must be shaped and positioned on the seat so they do not interfere with the holes, etc., which are related to the attachment of the back rest on the seat. As can be seen from the Figures showing the preferred embodiment, there is some possibility of this. Furthermore, the angling and location of the legs must be appropriate for the seat and back rest dimensions, so that the chair is stable when a person is sitting on, or otherwise using, the chair.

As mentioned at the beginning, although the invention has been shown and described with respect to a preferred embodiment, other variations are within contemplation. The following are examples of such variations.

Figure 7:
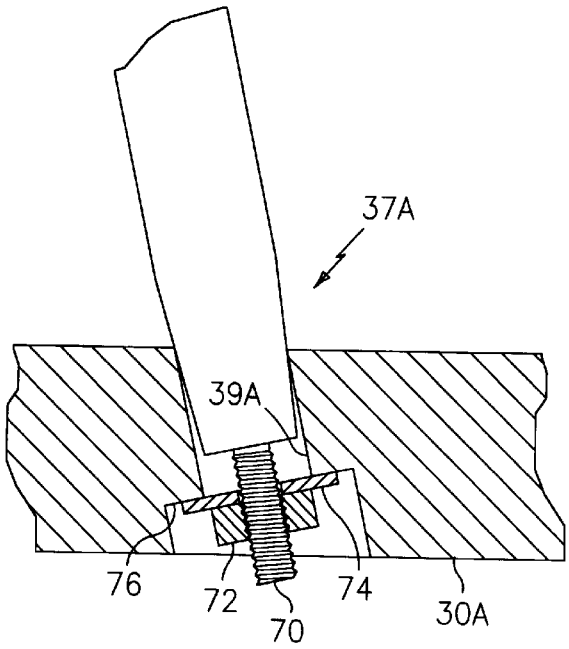
FIG. 7 is a view like that of FIG. 5, showing an alternative embodiment of the joint between the hoop lower end and seat.

While a bolt and barrel nut are much preferred, other fasteners or means for exerting lengthwise force on the ends of the hoop ends or stretcher rail, to draw and hold them in their respective holes, may be employed. For instance, a long wood screw, threading into the wood of the end of a member may be used to replace the bolt and barrel nut. For instance, as illustrated by FIG. 7, a threaded stud 70 may be permanently installed in the hoop end 37A, so that upon assembly it extends through a smooth cylindrical hole 39A in the seat 30A. A nut 72 and washer 76 press against the shoulder 74 of a boss of the hole 39A, to hold the end in place. The holes 39, 39A may be configured without the recess or boss which is shown on the underside, and a tapered washer may be substituted.

Referring again to FIGS. 1 and 7, the upper ends of the holes 39, 39A in the seat which receive the hoop ends may be tapered rather than straight walled, although doing so increases cost and adds a harder-to-control dimension variable which can vary the extent of vertical insertion of a hoop end into the hole. In another less preferred design alternative, rather than comprising conical sections, the lower ends of the hoop may be straight cylinders with or without shoulders; and, the holes in the seat may be tapered or straight.

While the base plate is preferably displaced to the rear from the plane of the hoop leg ends, to provide the desirable triangular structure configuration which was mentioned, in an alternative embodiment the base plate may lie in the same essential plane as the hoop. The base plate of the back rest may be fastened to the seat by means other than screws which run upwardly through holes from the bottom side of the seat. For instance, screws may run downwardly through the base plate into the seat top. Types of fasteners other than screws may be used.

Figure 8:
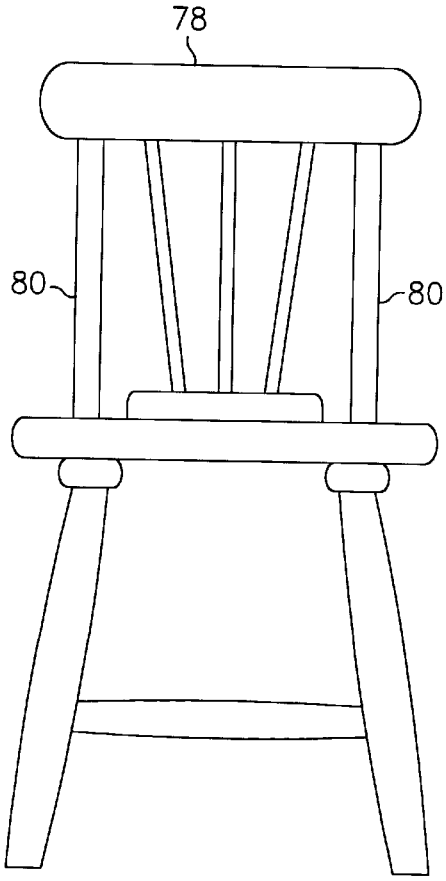
FIG. 8 is a front elevation view of a Windsor type chair having a different style backrest from that shown in FIG. 2.

The back rest hoop may have other shapes than the curved one which has been described. For instance, the hoop may be comprised of right angle pieces, namely, a horizontal top rail 78 and two downward running heavy weight outer spindles 80. See FIG. 8. Thus, the term hoop as used in the claims will be understood to encompass such shapes, together with other similarly functional shapes. Also, the back rest members may be fewer in number than shown in the Figures. For instance, the spindles may be replaced by a single member, such as contoured or perforated panel. Such a chair would not be called a Windsor type chair.

It will be understood by those skilled in this art that various other changes in form and detail may be made without departing from the spirit and scope of the claimed invention.

I claim:

1. A knock down chair comprising:

a horizontal seat having a top, a bottom, a front end, a rear end, and two spaced apart holes running from the top to the bottom of the seat;

a leg assembly, attached to the bottom of the seat, for supporting the chair on a surface;

a back rest, attached to the top of the seat, comprised of a hoop having a top portion and two spaced apart lower ends, each lower end running downwardly and into one of said spaced apart holes in the seat, the ends lying within a first plane which is nearly vertical;

a base plate fastened to the top of the seat;

at least one back rest member running from the top portion of the hoop to the base plate; and, means for fastening each of said hoop lower ends into the respective seat hole, the means pulling lengthwise on each of said lower ends within the hole;

wherein the base plate is attached to the top of the seat at a location spaced apart toward the rear of the seat from said first plane.

2. The chair of claim 1 wherein the chair is adapted for shipment in knock down condition and for assembly by a user.

3. The chair of claim 1 wherein each hoop lower end is comprised of a conical section having the narrow end thereof facing downwardly and inserted within the hole into which said hoop lower end runs.

4. The chair of claim 3 wherein the portion of each hole within which a hoop lower end is inserted has a straight cylindrical cross section in vicinity of the top of the seat.

5. The chair of claim 1 wherein the back rest comprises a hoop having a curved upper portion and comprises a plurality of back rest members which are spindles.

6. The chair of claim 1 wherein the means for fastening each of said hoop lower ends comprises a barrel nut captured within said end; and, a threaded bolt having a head, running upwardly from the bottom of the seat upwardly within the seat hole within which the end is positioned, to engage the barrel nut.

7. The chair of claim 6 wherein each hole has an internal shoulder against which the head of the threaded bolt presses upwardly.

8. A knock down chair comprising:

a horizontal seat having a top, a bottom, a front end, a rear end, and two spaced apart holes running from the top to the bottom of the seat;

a leg assembly, attached to the bottom of the seat, for supporting the chair on a surface;

a back rest, attached to the top of the seat, comprised of a hoop having a top portion and two spaced apart lower ends, each lower end running downwardly and into one of said spaced apart holes in the seat, the ends lying within a first plane which is nearly vertical;

a base plate fastened to the top of the seat;

at least one back rest member running from the top portion of the hoop to the base plate;

means for fastening each of said hoop lower ends into the respective seat hole, the means pulling lengthwise on each of said lower ends within the hole; and, a leg assembly comprised of two spaced apart opposing leg frames;

each frame comprised of two downward running legs connected by a spaced apart rung and frame top plate;

each frame top plate fastened to the bottom of the seat;

and, a stretcher rail connecting the rungs of the opposing frames.

9. The chair of claim 8 wherein the stretcher rail has opposing ends; each rung having a hole within which an end of the stretcher rail is inserted; wherein, a combination of barrel nut and bolt fasten each rung to an end of the stretcher rail.

10. The chair of claim 8 wherein the chair is adapted for shipment in knock down condition and for assembly by a user.

* * * * *